United States Patent [19]

Rabuffetti

[11] 3,944,767

[45] Mar. 16, 1976

[54] DISHWASHING MACHINE CLOSURE SAFETY SWITCH DEVICE

[75] Inventor: Sergio Rabuffetti, Trento via Della Collina, Italy

[73] Assignee: U.S. Philips Corporation, New York, N.Y.

[22] Filed: May 24, 1974

[21] Appl. No.: 473,218

[30] Foreign Application Priority Data

May 25, 1973 Italy ..... 24593/73

[52] U.S. Cl. ..... 200/61.62; 134/58 DL

[51] Int. Cl.[2] ..... H01H 3/16; B08B 3/00

[58] Field of Search ..... 200/61.62–61.75; 134/57 R, 57 D, 57 DL, 58 R, 58 D, 58 DL, 113; 16/49, 51, 61, 66, 82, 84, 85; 34/51, 55

[56] References Cited

UNITED STATES PATENTS

| | | | |
|---|---|---|---|
| 2,896,641 | 7/1959 | Kauffman et al. | 134/58 D |
| 3,229,061 | 1/1966 | Harroff | 200/61.62 |
| 3,728,512 | 4/1973 | Shirakami | 200/61.62 X |

*Primary Examiner*—James R. Scott

*Attorney, Agent, or Firm*—Frank R. Trifari; David R. Treacy

[57] ABSTRACT

Safety device for a dishwashing machine comprising a locking means allowing limited angular movement of the machine closure in case of vapor pressure build-up and a microswitch interrupting the pump circuit upon such angular movement or inadvertent opening of the closure.

2 Claims, 4 Drawing Figures

DISHWASHING MACHINE CLOSURE SAFETY SWITCH DEVICE

The invention relates to a safety device for a dishwashing machine, of the type having a housing enclosing a tub, a motor driven pump for feeding a water spraying device in the tub, and a closure for the access opening of the tub.

In dishwashing machines of this kind it is dangerous to open the door or lid while the machine is working, especially because the water usually is heated to a temperature of over 50°C. Another hazard is created by the fact that during the operation of the machine vapor pressure may build up to an unacceptable level. For this purpose an opening is usually created for steam to escape; however this frequently is unsatisfactory because water and foam are often ejected with the steam.

The object of the invention is to provide a safety device which satisfies both needs simultaneously and does not have the disadvantages of the prior art.

According to the invention, the device comprises locking means for the closure which in its locked position permits limited angular displacement of the closure under the influence of vapor pressure in the tub, and a switch in the pump motor circuit to be operated upon angular displacement of the closure.

In a preferred embodiment the locking means comprises a latch which is biased in its locked position by means of a spring and which is movable over a limited distance against the action of said spring.

In another preferred embodiment the switch is a microswitch placed in the closure construction and having an operating member engaged by a member attached to the housing to set the switch contacts in the closed position.

Figure 4:
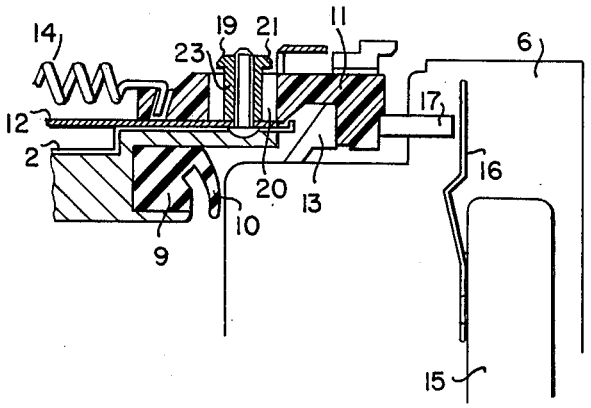
Figure 1:
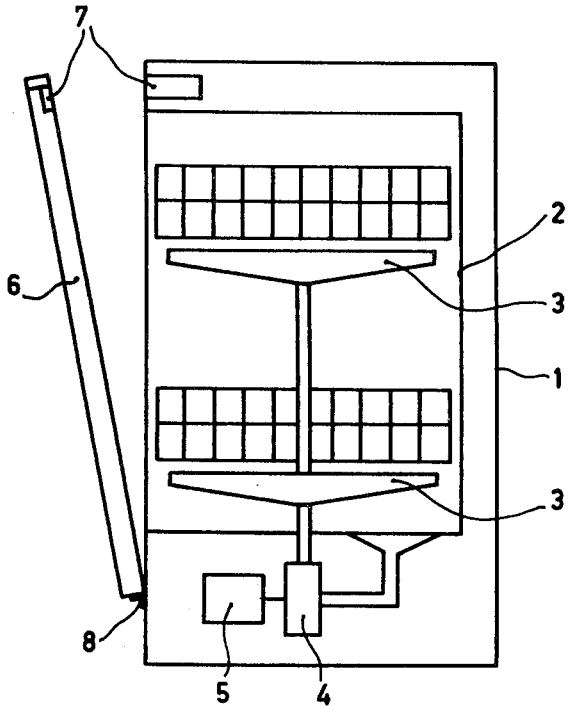
Figure 2:
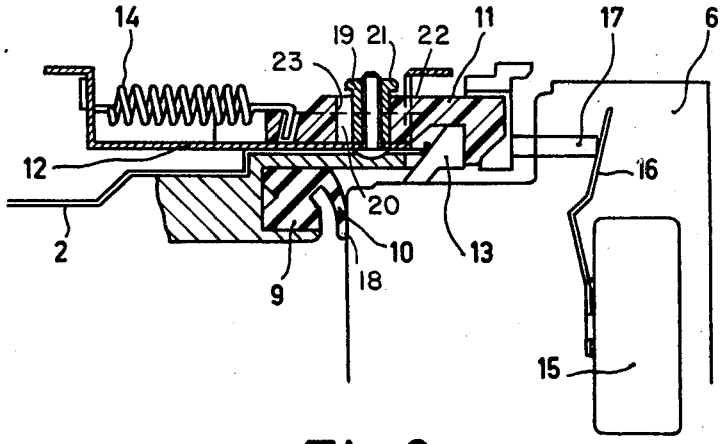
Figure 3:
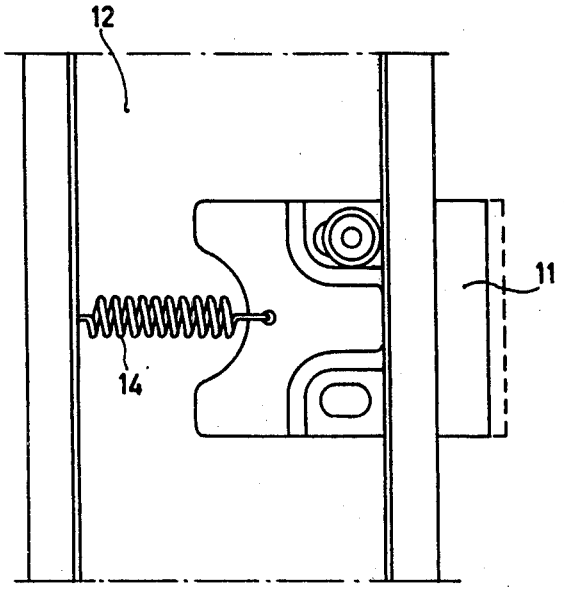

By way of example an embodiment of the invention will be described with reference to the accompanying drawing, in which FIG. 1 is a cross-sectional view of a dishwashing machine in which the invention is applied, FIG. 2 is a cross-section of the safety device in this machine with the closure in a tightly closed position, FIG. 3 is a plan view of this device and FIG. 4 is a partial cross-sectional view of the safety device with the closure moved to the angular limit by vapor pressure.

In FIG. 1 a dish-washing machine is shown having a housing 1, a tub 2, rotating water spray arms 3 in the tub, a pump 4 to feed water to these arms, the pump being driven by an electric motor 5, a closure 6 for closing the open side of the tub and a locking device 7, which in part is located in the housing and in part in the closure construction. The closure 6 is angularly movable about a hinge 8.

As may be seen in FIG. 2 the front edge of the tub 2 is provided with a closure strip 9, which strip has a flap 10 engaging the inner surface 18 of the closure 6 when this is in its closed position. This flap prevents moisture in the tub from passing the closure 6. This means at the same time that vapor collecting in the tub and building up a certain pressure cannot leave the tub. Because of the relative large surface of the closure 6 considerable force can be exerted on the locking device 7.

This locking device 7 consists of a latch 11 which is arranged slidably in a bracket 12 attached to the tub structure and located in the space between the housing 1 and the tub 2. A stop post 19 extending through a slot

20 in the latch 11 has a retaining flange 21 overhanging the top surface 22 of the latch to prevent vertical movement of the latch. The latch 11 may engage a catch 13 attached to the closure 6. The catch 13 may be disengaged from the latch 11 by any means well-known in the art, for example by moving catch 13 downward within the enclosure by means not shown. A spring-loaded mechanism as in a cabinet door, or combination manual and automatic mechanism as disclosed in U.S. Pat. No. 2,896,641 would be suitable. The latch 11 is attached to the bracket 12 by means of a spring 14 which tries to pull the latch 11 into the housing 1. Now if vapour pressure builds up inside the tub the force exerted on the closure 6 will tend to move this closure angularly away from the tub. This is allowed by the slidability of the latch 11 in the bracket 12, the angular motion being limited by a rear edge 23 of the slot abutting the stop post 19 when the desired limit of travel is reached, as shown in FIG. 4.

In the closure 6, which is a double walled panel construction, there is mounted a microswitch 15 which forms a part of the circuit of the pump motor 5. The operating lever 16 of this switch is held in the closed position by a protruding member 17 on the housing 1. However, as soon as the closure moves angularly away from the housing the operating lever 16, no longer being engaged by the protrusion 17, moves to the open position, so that the pump motor 5 stops and no water is circulated in the tub anymore. Thus a double safety is achieved by the safety device: it operates in case of too high a pressure in the tub and it opens if the closure is opened inadvertently during operation of the machine.

The device has been described as applied to a dishwashing machine having a closure in the form of a front door. It will be clear that the device can also be applied to machines having a closure in the form of a top lid. In that case the weight of the lid may wholly or partly take over the function of the spring 14.

What is claimed is:

1. A safety device for a dishwashing machine comprising a housing, a tub mounted in the housing, an electrically controlled means for spraying water in the tub, a closure for an access opening of the tub arranged to open by angular displacement, and electrical switch means for disabling said electrically controlled means when said closure is in an open position, wherein said device comprises a catch member mounted on said closure, a movable latch member mounted on said housing disposed to be engaged by said catch member while said closure is in a closed position and said latch member is in a first position, said latch member being movable to a second position by a given angular displacement of said closure from said closed position, said given angular displacement being such that any vapor enclosed under pressure within said tub may escape past said closure, a stop member connected to said housing for engaging said latch member so as to prevent movement of said latch member beyond said second position, and biasing means for urging said latch member from said second position toward said first position.

2. A device as claimed in claim 1 wherein said electrical switch means comprises an electrical switch and a member disposed so as to operate said switch means to be in an operating condition only when said enclosure is fully closed, said operating switch being in a disabling condition when said enclosure has been opened by said given angular displacement.

* * * * *